US006026650A

United States Patent [19]

Beaverson et al.

[11] Patent Number: 6,026,650

[45] Date of Patent: Feb. 22, 2000

[54] FREEZE POINT PROTECTION FOR WATER COOLED CHILLERS

[75] Inventors: Gregory K. Beaverson, York; William McQuade, New Cumberland, both of Pa.

[73] Assignee: York International Corporation, York, Pa.

[21] Appl. No.: 09/232,557

[22] Filed: Jan. 15, 1999

[51] Int. Cl.[7] ..... F25D 17/02

[52] U.S. Cl. ..... 62/126; 62/130; 62/201; 340/588

[58] Field of Search ..... 62/228.1, 201, 62/125, 126, 127, 129, 130, 226, 227, 185; 340/584, 588

[56] References Cited

U.S. PATENT DOCUMENTS 4,270,361 6/1981 La Barge ..... 62/201 X
4,493,191 1/1985 Hanson ..... 62/126
4,538,422 9/1985 Mount et al. ..... 62/201
4,549,403 10/1985 Lord et al. ..... 62/201

*Primary Examiner*—Harry B. Tanner
*Attorney, Agent, or Firm*—Finnegan, Henderson, Farabow, Garrett & Dunner, L.L.P.

[57] ABSTRACT

A freeze point protection method and system is provided for water cooled chillers. The method prevents freezing of chilled water and damage to the chiller. The method allows the evaporator temperature to drop below a freezing temperature for a predetermined amount of time prior to shutting down the chiller. The temperature of the refrigerant in the water chiller is periodically sensed. The amount of time that the chiller is below a predetermined freezing temperature is periodically counted and compared with a determined maximum time that the chiller may operate at a sensed temperature below the predetermined freezing temperature without damaging the chiller. The method will shut down the water chiller if the counted time exceeds the determined maximum time. A system for shutting down a water cooled chiller to prevent freezing of chilled water is also provided.

20 Claims, 4 Drawing Sheets

FREEZE POINT PROTECTION FOR WATER COOLED CHILLERS

BACKGROUND OF THE INVENTION

1. Field of the Invention

The present invention relates to a method for preventing freezing of the chilled water in a water cooled chiller within an HVAC system. The invention also relates to a system for preventing freezing of the chilled water in a water cooled chiller.

2. Background of the Invention

It is often necessary to operate water cooled chillers at temperatures within a few degrees of the freezing point of water. As is known, the water in the chiller is cooled in a heat exchanger where the water is cooled by a refrigerant that accepts heat from the water in an evaporator. In existing water chillers, the control system is often programmed to shut down the water chiller as soon as the evaporator temperature decreases to a certain temperature below freezing. The shutdown may occur even though this temperature drop would only be temporary and would not result in freezing of the water in the water chiller. These transient temperature drops are often due to system disturbances caused by varying building loads, start-up, or any number of other reasons. These shutdowns are often unnecessary because the water inside the tubes will not freeze immediately.

SUMMARY OF THE INVENTION

It would be advantageous to have a system which will permit the chiller to continue running for a limited time through such a disturbance if shutdown of the HVAC system is unnecessary. Such a system or method will prevent the high costs associated with frequent shutdowns.

Accordingly, an object of the invention is to provide an improved method and system of protecting water cooled chillers in HVAC systems from freezing, without unnecessary shutdowns of the HVAC system.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a method of shutting down a water cooled chiller to prevent undue freezing of chilled water and damage to the chiller. The method includes the steps of: periodically sensing the temperature of refrigerant in the water chiller; periodically counting at predetermined intervals the amount of time that the sensed temperature is below a predetermined freezing temperature; periodically comparing at predetermined intervals the counted time with a determined maximum time that the evaporator may operate at a sensed temperature below the predetermined freezing temperature without damaging the chiller; and shutting down the water chiller if the counted time exceeds the determined maximum time at one of said predetermined intervals.

In a further aspect, the method includes the steps of periodically comparing the sensed temperature with a predetermined minimum shutdown temperature and shutting down the chiller if the sensed temperature falls below the predetermined minimum shutdown temperature.

In another aspect, the step of counting the amount of time that the refrigerant in the chiller is below a predetermined freezing temperature may include the steps of increasing the count by a preselected increment during each preselected interval the sensed temperature falls below the predetermined freezing temperature and decreasing the count by the preselected increment during each preselected interval the sensed temperature is equal to or greater than the predetermined freezing temperatures.

In a yet further aspect, the method may further include the step of shutting down the chiller if the sensed temperature is below a predetermined minimum shutdown temperature, even if value of the count is not greater than the determined maximum time. The method may also include the step of calculating during each preselected interval the determined maximum time that the chiller may operate at a sensed temperature below the predetermined freezing temperature. The predetermined intervals for the counting and the comparing steps are the same intervals.

In another aspect, the step of shutting down the chiller can only occur if the sensed temperature is below the predetermined freezing temperature.

In another aspect, the step of periodically sensing the temperature of the refrigerant in the chiller is performed by a direct temperature sensing device. Alternately, the step of periodically sensing the temperature of the refrigerant in the chiller may be performed by a pressure transducer.

The invention also includes a system for shutting down a water cooled chiller to prevent undue freezing of chilled water and damage to the chiller. The system includes a sensor for periodically measuring the temperature of refrigerant in the chiller; means for storing the maximum time that the chiller is permitted to be at a sensed temperature below a predetermined freezing temperature without damaging the chiller; and a controller that periodically counts at predetermined intervals the amount of time that the sensed temperature is below the predetermined freezing temperature, compares the amount of time with the determined maximum time, and shuts down the chiller if the counted time is greater than the determined maximum time.

It is to be understood that both the foregoing general description and the following detailed description are exemplary and explanatory only and are not restrictive of the invention, as claimed. The accompanying drawings, which are incorporated in and constitute a part of this specification, illustrate embodiments of the invention and together with the description, serve to explain the principles of the invention.

DESCRIPTION OF THE PREFERRED EMBODIMENTS

Figure 1:
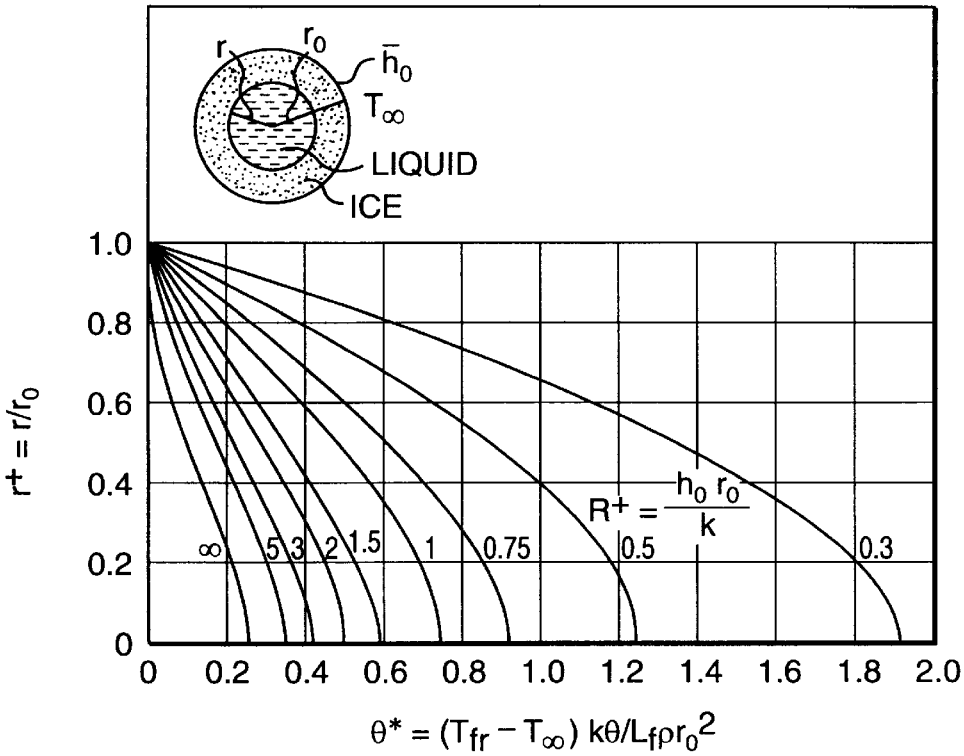
FIG. 1 is a graph for calculating the dimensionless time to complete solidification of liquid in a tube.

Reference will now be made in detail to the present preferred embodiments of the invention, examples of which are illustrated in the accompanying drawings. Wherever possible, the same reference numbers will be used throughout the drawings to refer to the same or like parts.

This invention is directed to methods and systems for protecting a water chiller from damage caused by undue freezing of water within the chiller. A general system to which the invention is applied is illustrated, by means of example, in FIG. 4. As shown, the water chiller is incorporated into an HVAC refrigeration system 100 that includes a centrifugal compressor 110, a condenser 112, a water chiller (an evaporator) 126, and a control panel 140 for the system. The centrifugal compressor 110 compresses the refrigerant vapor and delivers it to the condenser 112 via line 114. The condenser includes a heat-exchanger coil 116 connected to a cooling tower 122. The condensed liquid refrigerant from condenser 112 flows via line 124 to an evaporator 126. The evaporator 126 includes, for example, a heat-exchanger coil 128 having a supply line 128S and a return line 128R connected to a cooling load 130. Water travels into the evaporator via return line 128R and exits the evaporator via supply line 128S. The evaporator chills the temperature of the water in the tubes. The heat-exchanger coil 128 may include a plurality of tube bundles. The vapor refrigerant in the evaporator 126 then returns to compressor 110 via a suction line 132 to complete the cycle.

The system includes a sensor 160 for sensing the temperature or pressure within the water chiller. The sensor is preferably at a location between a bundle of tubes in the evaporator shell. The sensor is typically located in the refrigerant flow. The signal 162 from the sensor is applied to a control panel 140 that includes an analog to digital (A/D) converter 148, a microprocessor 150, a non-volatile memory 144, and an interface module 146. The operation of the control panel will be discussed in greater detail below. The conventional liquid chiller system includes many other features which are not shown in FIG. 4. These features have been purposely omitted to simplify the drawing for ease of illustration.

Water chillers are often specified to operate with leaving water temperatures within a few degrees Fahrenheit of the freezing point of water (32 deg. F). Transients in chiller operating conditions caused by start-up, varying building loads, etc. can cause the evaporator refrigerant saturation temperature to temporally drop below this value. If left at this condition for a sufficient period of time, ice can form inside chilled-water tubes of the evaporator. In extreme cases, the water inside the tubes can freeze solid splitting the tube and causing damage to the unit.

The purpose of the present invention is to provide freeze point protection methods and systems that allow the refrigerant temperature in the chiller to drop below the freezing point of water for limited periods of time without immediately shutting down. The methods and systems of the present invention will shut down the water chiller after a calculated amount of time, but will prevent the type of shut downs which are unnecessary. On the other hand, the present method will effectively prevent the tubes from freezing. To accomplish this, a method was developed to determine a safe time limit that a chiller could operate below the freezing point of water. Because the time required for water to freeze is dependent on the how far below the freezing point the evaporator temperature is, this time limit must be adjusted for different chiller temperatures. As explained below, the preferred method is to apply a mathematical algorithm that determines the appropriate safe time period for a sensed refrigerant temperature in the chiller. According to the invention, different algorithms can be used to determine this time, as can empirical testing of a given system. For example, determinations of safe time periods for a given temperature can be obtained, by subjecting specific water chillers to different freezing temperatures and determining the time needed to freeze water to a predetermined stage at each temperature. Through such empirical testing, a table of data points can be determined and placed into a memory of a computer system of the type described below. The preference, however, is to use an algorithm, based on appropriate assumptions that can analytically determine maximum safe times for a given sensed temperature of the refrigerant.

By means of example, to develop this algorithm, a mathematical transient conduction analysis was performed on a representative evaporator tube. In order to decrease the risk of freezing with this method, a preferred algorithm was developed based on the worst-case scenario for chiller freezing. The worst-case scenario where freezing of the water chiller will occur in the shortest period of time is in the unlikely case of the evaporator tube being partially or fully blocked by a pass baffle gasket or some other obstruction. In this scenario, the water cannot enter or exit the tube but instead is trapped in the tube while the surrounding refrigerant vapor is brought below the freezing point. Because the water cannot transfer heat convectively (neglecting minor natural convection effects), the principal mode of heat transfer becomes conduction in the radial direction.

With the conductivity of the copper tubing and the length to diameter ratio of a given tubing being known, a Fourier radial conduction equation simplifies to a form that is solvable mathematically. The numerical heat transfer problem of liquid freezing inside a long circular tube immersed in a medium at a temperature below the freezing point of the liquid was solved by London and Seban in 1943. Their equation for dimensionless time parameter was applied to the current application under the following assumptions:

1. The physical properties of ice, density, conductivity, and latent heat of fusion are constant.

2. The liquid is initially at the solidification temperature (32 deg. F.).

3. The heat transfer coefficient on the outside of the tube is constant during the process.

4. The saturation temperature of the refrigerant evaporating on the outside of the tube is constant.

FIG. 1 shows the solution for the dimensionless time to complete solidification of the liquid. Dimensionless time $\Theta^*$, in this case, corresponds to the abscissa intercept $r+=r/r_o=0$ at the appropriate value of the system parameter $h_o r_o/k$. This corresponds to the dimensionless time for complete solidification of the tube (where r=0).

$$\Theta^*=(T_{fr}-T_\infty)k\Theta/L_f\rho r_o^2 \qquad \text{Equation 1}$$

where $L_f$=latent heat of fusion of ice $\rho$=density of solid phase $T_{fr}$=freezing point temperature $T_\infty$=measured saturation temperature of the evaporator k=thermal conductivity of the ice $\Theta$=time for complete solidification of the tube $r_o$=tube inside radius $h_o$=outside surface heat transfer coefficient The dimensionless time $\Theta^*$ for complete solidification of the tube is found from FIG. 1. This value can then be input into equation 1, in order to solve for $\Theta$, the time for complete solidification of the tube.

Figure 2:
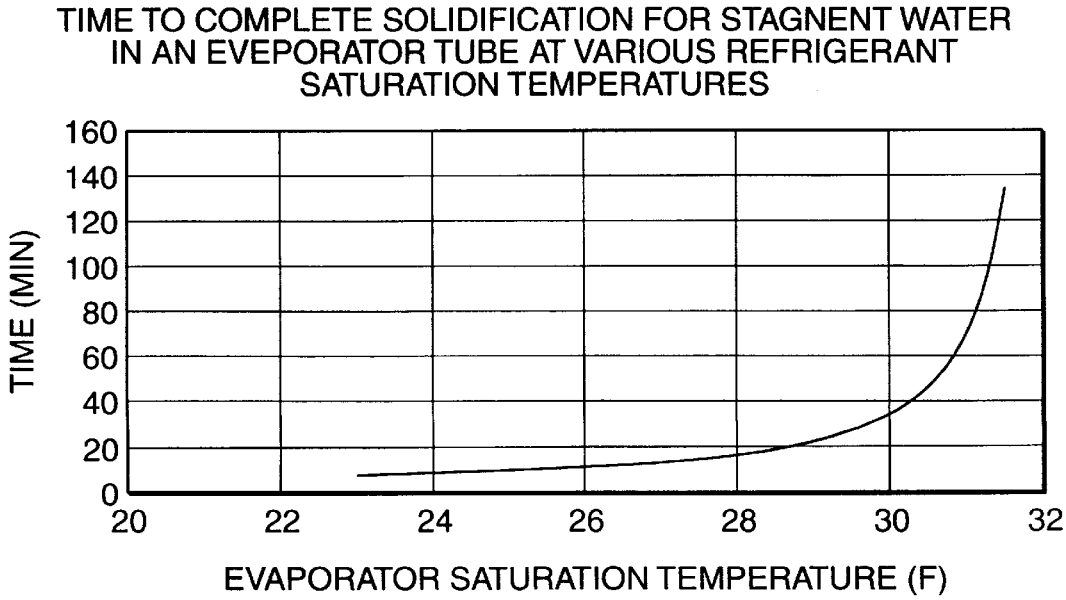
FIG. 2 is a graph showing the time for solidification of stagnant water in an evaporator tube at various refrigerant saturation temperatures.

When the system parameters for a specific case were applied to the above solution, the following curve of time to complete solidification of water inside a standard evaporator tube at various saturation temperatures was obtained, as shown in FIG. 2. This table is based upon a standard design for the evaporator at standard conditions, and is exemplary only. The table of data in FIG. 2 is not restrictive of the invention. FIG. 2 corresponds to London, A. L., and Seban, R. A., "Rates of Ice Formation", ASME Transactions, Vol. 65, 1943, American Society of Mechanical Engineers. According to a preferred embodiment of the present invention, the maximum time limits determined are weighted by an appropriate margin of safety and then incorporated into the control logic of the method and systems of the invention.

Figure 4:
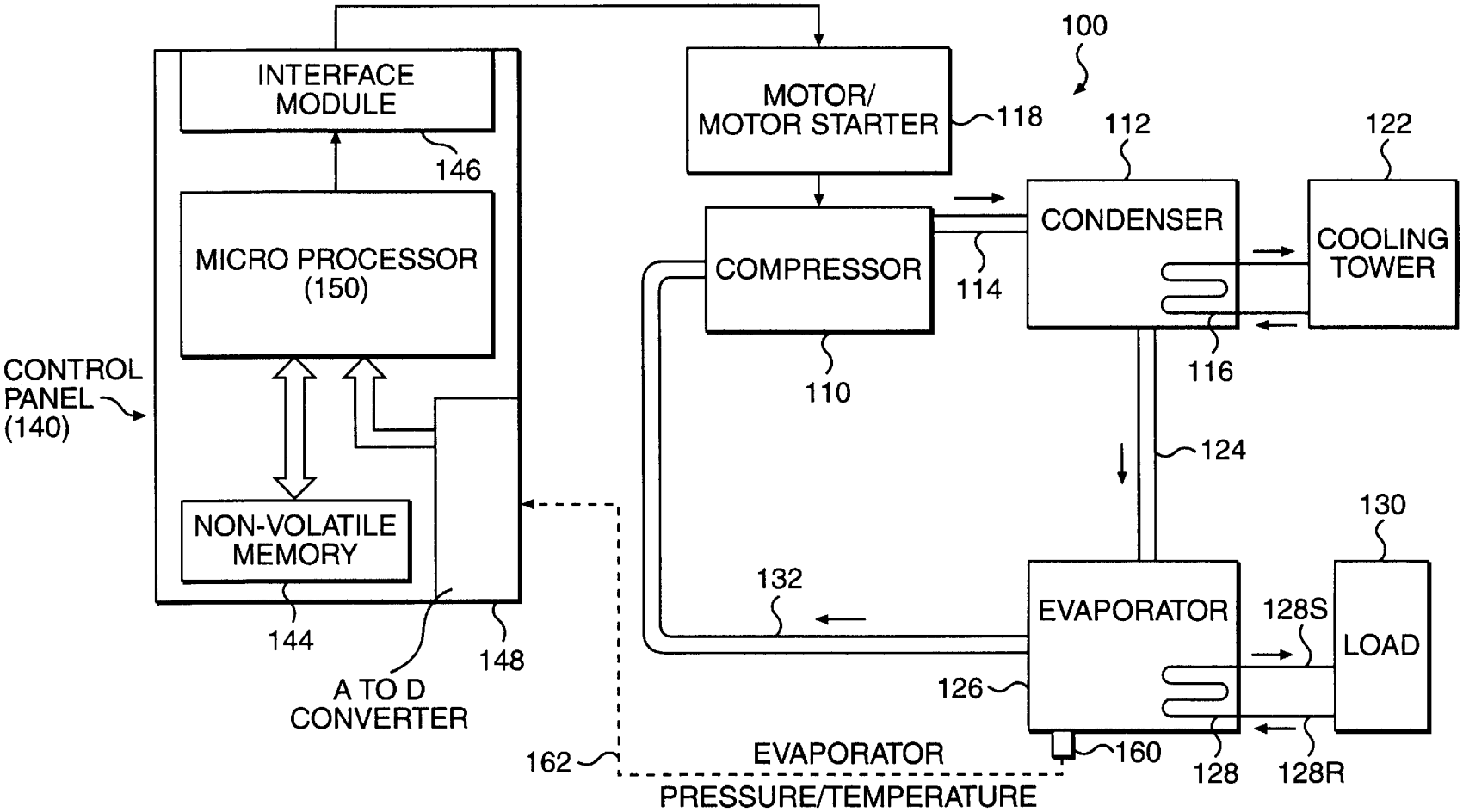
FIG. 4 is a diagram of a refrigeration system and control panel consistent with this invention.

The Smart Freeze Point Protection Control Algorithm will be described next. The control logic system monitors the evaporator saturation temperature at preselected time intervals, on a continual basis. An example of a control panel 140 for the refrigeration system is shown in FIG. 4. A sensor 160 is provided for measuring the evaporator temperature or pressure. A direct temperature sensing device such as a thermistor may be used to measure the evaporator temperature. Alternately, a pressure sensing device such as a pressure transducer may be used to measure the evaporator pressure. Other types of temperature and pressure sensors may also be employed. If a pressure transducer is employed, the pressure sensor/transducer 160 will generate a DC voltage signal 162 proportional to the evaporator pressure. Typically this signal 162 is between 0.5 and 4.5V (DC). If a thermistor is employed, the thermistor will provide a resistance which is proportional to the temperature. This is converted to a voltage signal 162 via a resistor divider connected via a voltage source. The voltage signal 162 is an input to control panel 140 and is converted to a digital signal by A/D converter 148. This digital signal representing the evaporator pressure/temperature can now be converted by the microprocessor 150 into a corresponding evaporator saturation temperature. This value is now input into the freeze point protection software routine which is described in more detail in the following paragraphs. The control panel also includes an interface module 146 which is used to shut down the chiller when the freeze point protection routine signals that a shutdown is appropriate. The chiller may be shut down by any conventional method, for example, by sending a signal to a motor starter/motor 118 which will shut down the compressor 110. However, the invention is not necessarily limited to this method of shutdown.

FIG. 3 illustrates one embodiment of the freeze point routine of the present invention. The operation of the routine is as follows. If the unit has just been turned on prior to the start, the value of freeze_count will be set equal to zero during initialization. Freeze_count is the value of a counter which keeps track of the time the evaporator temperature is located above or below the freezing point. After starting the routine, the routine proceeds to step 1. If the freeze_point feature is not active, the routine proceeds to step 16 (indicate by circle C). During step 16, the shutdown is cleared. In clearing a shutdown, the control logic indicates that no shutdown is to occur based on this control feature. The routine then proceeds to step 17, where the status of the shutdown is posted. In this case, it will be posted that there is no shutdown. Step 17 will be referred to as posting the status of the shutdown. After step 17, the routine will end (at which point the routine may be reentered after executing other control routines).

If the freeze_point feature is found to be active in step 1, then the routine proceeds to step 2. The value of the freeze_count at this point in the routine is equal to either zero (if the routine has just been initialized) or the last remaining value of freeze_count prior to the end of the previous routine. In step 2, the current evaporator saturation temperature is determined and a tolerance offset is incorporated into the system. This offset can be placed into the software when it is developed, or can be manually input (by a keypad) for a particular application. Preferably, the tolerance offset represents the worst case sensor error. For example, it can be a programmed constant equal to 0.8 deg. F. for a thermistor and 1.0 deg. F. for the pressure transducer. The routine then proceeds to step 3.

For timing purposes of the freeze_count variable, a regular time interval of one second is employed here (however, other intervals could be employed). Freeze_count will be incremented or decremented once every second, thus achieving the equivalent of a timer with one second resolution. In step 3, a timer that was set to one second at program initialization is checked. If one second has expired, then the timer is reset at step 4. If one second has not expired, the routine proceeds to step 9, the connection between FIG. 3A and 3B being indicated by the circle B. However, if the timer has been reset at step 4, the routine proceeds to step 5. At step 5, the evaporator temperature is compared to the freeze_point temperature plus the tolerance offset. The freeze_point temperature is the freezing_point of the water in the chiller. If the sensed evaporator temperature is less than the freeze_point temperature plus tolerance offset, then the routine proceeds to step 7 where the value of the freeze_count is incremented by one. The value of freeze_count will now be equal to the previous freeze_count plus one, and the routine proceeds to step 9. Otherwise, if the evaporator temperature is not less than the freeze_point temperature plus tolerance offset, the routine proceeds to step 6. If the freeze_count at step 6 is greater than zero, then the routine proceeds to step 8 where the value of the freeze_count is decremented by one. The value of freeze_count will now be equal to the previous freeze_count minus one, and the routine proceeds to step 9. In step 6, if the value of the freeze_count is not greater than zero, the freeze_count value will not be decremented, but will remain the same, and the routine will proceed to step 9.

One of the aspects of the present invention, and thus the illustrative subroutine explained herein, is to prevent the counter from automatically resetting to zero each time the temperature rises above the freezing point. In step 8, the value of the freeze_count (which represents the freeze point time) is decremented by one if the evaporator temperature is equal to or greater than the freeze_point plus offset (assuming the freeze_count is greater than zero). It would be dangerous to have the counter reset each time the temperature rises to the temperature threshold for only a one second interval. Each transient rise above the threshold may be followed by a large amount of time where the temperature is below the threshold. Instead of completely resetting when the temperature rises to the threshold, the counter will stop incrementing and instead decrement one count toward zero. In this manner, if the temperature change were to reverse and the temperature were to drop below the threshold, the freeze_count value will represent the amount of time (number of increments, such as one second) that the temperature was below the threshold minus the time the temperature was above or equal to the threshold. By not resetting to zero just because the temperature had previously risen above the threshold, the chiller is allowed to remain at a temperature below the threshold for a shorter time than if the counter had been reset to zero. This logic is necessary especially for situations where the chiller may be operating on the edge of the freeze point (i.e., when the saturation temperature is oscillating about the freeze point).

Figure 3A:
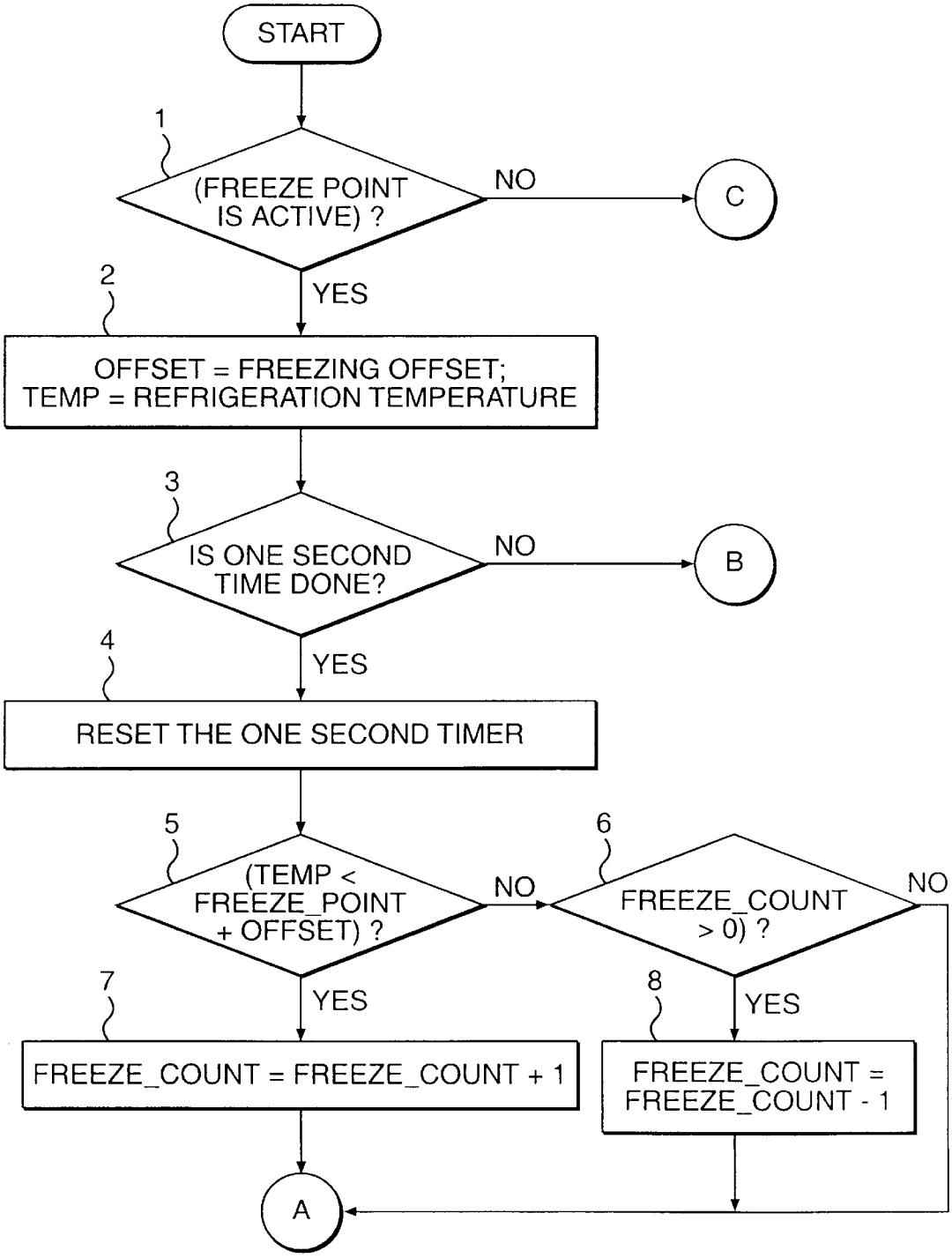
FIG. 3A and 3B are flow charts showing the smart freeze protection routine.
Figure 3B:
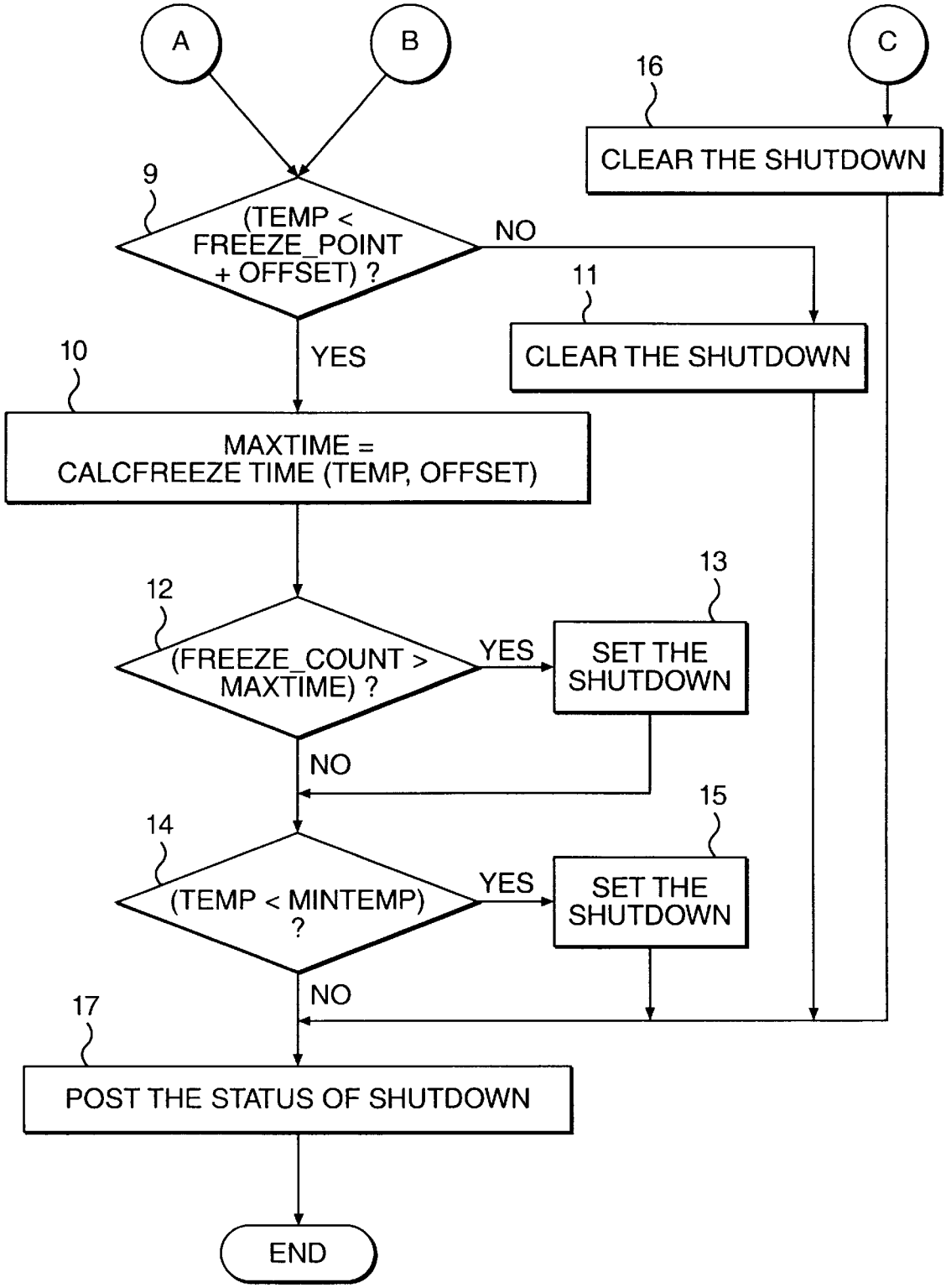

In step 3, if the one second interval has not expired, the timer is not reset and the routine proceeds to step 9 (the connection between FIG. 3A and 3B is indicated by circle B). The value of the freeze_count is only incremented or decremented at one second intervals, however, the routine may be completed many times a second.

As shown in FIGS. 3A and 3B, the routine proceeds from the portion indicated as the circles A and B to step 9. At step 9, the evaporator temperature is compared to the freeze_point temperature plus tolerance offset. If the evaporator temperature is not less than the freeze_point temperature plus tolerance offset, then the routine proceeds to step 11. If the routine proceeds to step 11, no shutdown will occur. At step 11, the shutdown will be cleared and the routine will proceed to step 17 where the status of the shutdown is posted. In this case, it will be posted that there is no shutdown and the routine will be exited.

However, if the evaporator temperature is less than the freeze_point temperature plus tolerance offset at step 9, then the routine proceeds to step 10. At step 10, the maximum time water can stand at the respective evaporator temperature without freezing is calculated for the most recently sensed temperature. This corresponds to the time it would take for complete solidification of the water in the evaporator tube, resulting in damage to the chiller. As discussed previously, this is based upon a worst-case scenario where flow in the tube is completely blocked. The maximum time may be calculated using the following formula which is a re-statement of equation 1 above along with the necessary parameters required for its calculation. The values for the variables listed below depend on the specific heat exchanger characteristics and conditions present. The values below are exemplary only. Ultimately, the number of seconds (for maximum time) is calculated based on how far the saturation temperature is below the freeze point. The equation is as follows:

$$\text{Max time(seconds)}=[\Theta^*\times L_F\times\rho_f\times[(r_o/12)^2/(((T_{fr}+T_{offset})-T_{shell})\times k_{ice})]]\times 3600$$

where:

$T_{fr}$=32.0 deg. F.

$T_{offset}$=0.8 to 1.0 deg. F.

$T_{shell}$=measured saturation temperature of the evaporator $L_f$=143.6

$k_{ice}$=1.34

$\rho_f$=57.3

$h_o$=3000

$r_o$=0.325

$R=h_o\times(r_o/(12\times k_{ice}))$

If R is greater than 10, then $\Theta^*$=0.25

Once the maximum time for the evaporator tube to freeze is calculated, the freeze_count value is compared to the maximum time value at step 12. Because the freeze_count value is incremented (or decremented) once per second, the freeze_count value represents the time in seconds that the saturation temperature is below the freezing threshold (minus the time that the saturation temperature is above the freezing threshold). If the freeze_count value is greater than the maximum time value, then the routine proceeds to step 13, where the shutdown is set. After the shutdown is set, the routine proceeds to step 14. At step 12, the freeze_count value may be less than or equal to the maximum time value. This will occur if the amount of time which the temperature has been below the threshold (minus the amount of time above) has not reached the calculated amount of time for freezing to occur. The routine will proceed to step 14.

The unit may still be shut down if the evaporator temperature has dropped below a predetermined minimum temperature. This minimum temperature represents a temperature at which the freezing will occur so rapidly that it would be dangerous to operate the chiller, even for a short time. In the case of the example above, the minimum temperature is set at 25 deg. F. In step 14, if the evaporator temperature is below the minimum temperature, a shutdown is set at step 15. If the evaporator temperature is not less than the minimum temperature, no shutdown will be set. However, a shutdown may have already been set as a result of step 13. The status of the shutdown or lack thereof will be posted at step 17. If a shutdown was set at both 13 and step 15, the system may be programmed so that both shutdowns are posted at step 17. Alternately, if the answer to steps 12 and 14 was no, then no shutdowns will be set, and step 17 will post that there are no shutdowns. After step 17, the routine will always be exited. The routine may be restarted immediately thereafter.

In the above method and system, the control device may indicate the reason that the shutdown is occurring. A shutdown may occur for other reasons besides those discussed above for freezepoint protection. This indication of the reason for shutting down is referred to as posting the shutdown.

It will be apparent to those skilled in the art that various modifications and variations can be made in the design of the present invention and in construction of this freeze point protection method and system without departing from the scope or spirit of the invention. Other embodiments of the invention will be apparent to those skilled in the art from consideration of the specification and practice of the invention disclosed herein. It is intended that the specification and examples be considered as exemplary only claims.

We claim:

1. A method of shutting down a water cooled chiller to prevent undue freezing of chilled water and damage to the chiller, comprising the steps of:

periodically sensing the temperature of refrigerant in the chiller;

periodically counting at predetermined intervals the amount of time that the refrigerant is below a predetermined freezing temperature;

periodically comparing at predetermined intervals the counted time with a determined maximum time that the chiller may operate at a sensed temperature below the predetermined freezing temperature without damaging the chiller; and shutting down the chiller if the counted time exceeds the determined maximum time at one of said predetermined intervals.

2. The method according to claim 1 further comprising the steps of:

periodically comparing the sensed temperature with a predetermined minimum shutdown temperature; and shutting down the chiller if the sensed temperature falls below the predetermined minimum shutdown temperature.

3. The method according to claim 1, wherein the step of counting the amount of time that the refrigerant in the chiller is below a predetermined freezing temperature includes the steps of increasing the count by a preselected increment during each preselected interval the sensed temperature falls below the predetermined freezing temperature and decreasing the count by the preselected increment during each preselected interval the sensed temperature is equal to or greater than the predetermined freezing temperatures.

4. The method according to claim 3, further including the step of shutting down the chiller if the sensed temperature is below a predetermined minimum shutdown temperature, even if value of the count is not greater than the determined maximum time.

5. The method according to claim 1, further comprising the step of calculating during each preselected interval the determined maximum time that the chiller may operate at a sensed temperature below the predetermined freezing temperature.

6. The method according to claim 5, wherein the determined maximum time that the chiller may operate at a sensed temperature below the predetermined freezing temperature without damaging the chiller is determined based on the assumption that water within the chiller is blocked and there is no flow through the chiller.

7. The method according to claim 3, wherein the determined maximum time that the chiller may operate at a sensed temperature below the predetermined freezing temperature without damaging the chiller is determined based upon empirical testing of the chiller.

8. The method according to claim 5, wherein the determined maximum time that the chiller may operate at a sensed temperature below the predetermined freezing temperature without damaging the chiller is the time corresponding to the most recently sensed temperature.

9. The method according to claim 3, wherein the step of decreasing the count by a preselected increment each time the sensed temperature is equal to or greater than the predetermined freezing temperature only occurs if the value of the count is greater than zero.

10. The method according to claim 1, wherein the predetermined intervals for the counting and the comparing steps are the same intervals.

11. The method according to claim 1, wherein the step of shutting down the chiller can only occur if the sensed temperature is below the predetermined freezing temperature.

12. The method according to claim 1, wherein the predetermined freezing temperature is the sum of the freezing point of the water in the chiller and a temperature offset.

13. The method according to claim 6, wherein the determined maximum time is determined by the application of an analytical algorithm based on the heat exchange characteristics of the chiller.

14. The method according to claim 1, wherein the step of periodically sensing the temperature of the refrigerant in the chiller is performed by a direct temperature sensing device.

15. The method according to claim 1, wherein the step of periodically sensing the temperature of the refrigerant in the chiller is performed by a pressure transducer.

16. A system for shutting down a water cooled chiller to prevent undue freezing of chilled water and damage to the chiller comprising:

a sensor for periodically measuring the temperature of refrigerant in the chiller;

means for storing the maximum time that the chiller is permitted to be at a sensed temperature below a predetermined freezing temperature without damaging the chiller; and a controller that periodically counts at predetermined intervals the amount of time that the sensed temperature is below the predetermined freezing temperature, compares the amount of time with the determined maximum time, and shuts down the chiller if the counted time is greater than the determined maximum time.

17. The system according to claim 16, further comprising a determining means for determining during each interval the maximum time that the chiller is permitted to be at the temperature sensed during that interval, without damaging the chiller.

18. The system according to claim 16, wherein the storing means stores a plurality of maximum times associated with different temperatures of the chiller.

19. The system according to claim 16, wherein the storing means is a computer memory.

20. The system according to claim 17, wherein said controller includes software for increasing the count by a preselected increment during each preselected interval the sensed temperature falls below the predetermined freezing temperature and decreases the count by the preselected increment during each preselected interval the sensed temperature is equal to or greater than the predetermined freezing temperature.

* * * * *